United States Patent [19]

Bo

[11] 4,275,652

[45] Jun. 30, 1981

[54] MARKING HEAD FOR COLD STAMPING SYMBOLS ON A METALLIC SURFACE

[75] Inventor: Ermanno Bo, Ternay, France

[73] Assignee: Societe Anonyme Dite BBM, Feyzin, France

[21] Appl. No.: 112,408

[22] Filed: Dec. 31, 1979

Related U.S. Application Data

[63] Continuation of Ser. No. 902,096, May 1, 1978, abandoned.

[30] Foreign Application Priority Data

May 3, 1977 [FR] France ..... 77 14018

[51] Int. Cl.[3] ..... B44B 5/00

[52] U.S. Cl. ..... 101/4; 101/28; 403/327

[58] Field of Search ..... 101/3 R, 4, 28; 403/93, 403/327, 328

[56] References Cited

U.S. PATENT DOCUMENTS

| | | | |
|---|---|---|---|
| 401,003 | 4/1889 | Burns | 403/327 X |
| 947,463 | 1/1910 | Sundberg | 403/327 X |
| 1,301,367 | 4/1919 | Bowler | 3/12.4 |
| 1,566,864 | 12/1925 | Hauer | 101/28 |
| 2,035,149 | 3/1936 | Dolan | 101/4 |
| 2,317,861 | 4/1943 | Speicher et al. | 101/28 |
| 2,424,397 | 7/1947 | King | 101/28 |
| 2,627,803 | 2/1953 | Pannier | 101/4 |
| 2,896,530 | 7/1959 | Bernard | 101/4 |
| 3,207,066 | 9/1965 | Gartside | 101/4 |
| 3,762,484 | 10/1973 | Speicher | 101/3 R X |
| 4,006,786 | 2/1977 | Speicher | 101/3 R X |
| 4,086,851 | 5/1978 | Brandell | 101/4 |

*Primary Examiner*—Clifford D. Crowder
*Attorney, Agent, or Firm*—Michael J. Striker

[57] ABSTRACT

A marking head for cold stamping letters, numbers or other symbols provided on free ends of a plurality of stamps on a metallic surface. The stamps of the marking head are operated by explosion of a cartridge in a striking tool connected to the marking head to thereby move a piston of the tool, and a force transmitting member is arranged in the marking head to transmit the blow imparted to the piston onto the stamps.

10 Claims, 3 Drawing Figures

MARKING HEAD FOR COLD STAMPING SYMBOLS ON A METALLIC SURFACE

CROSS-REFERENCE TO RELATED APPLICATION

This application is a continuation of application Ser. No. 902,096 filed May 1, 1978, now abandoned.

BACKGROUND OF THE INVENTION

The present invention relates to a marking head for cold stamping symbols such as letters, numbers, or the like on a metallic surface.

The simplest way for cold stamping symbols on a metallic surface is to take a punch provided at its bottom face with the desired symbol and hit the top face of the punch with a hammer. This manner of cold stamping symbols onto a metallic surface has, however, various disadvantages in that it is difficult to provide in every case the same hammer blow and to align the punch properly with respect to the metallic surface to be stamped. Therefore, different tools have been developed for carrying out cold stamping of symbols on a metallic surface in a more efficient and rapid manner.

An automatic striking apparatus is known which uses a sliding plunger, forming the hammer and which is acted upon by a spring during use of the apparatus. The use of this apparatus is, however, limited since if the spring is calibrated to provide the necessary force for cold stamping relatively soft metals or alloys, it will not have the ncessary force to properly act on steel or hard alloy surfaces. In such a case apparatus is used which is equipped with jacks operating levers and arranged to act on stronger springs, but this apparatus is rather cumbersome. Other apparatus for this purpose are also known in the art, but all of the same are difficult to operate, while not providing a perfect stamping of symbols on metallic surfaces of different hardness.

SUMMARY OF THE INVENTION

It is an object of the present invention to provide a marking head for cold stamping symbols onto a metallic surface and which avoids the difficulties of such marking heads known in the art.

It is a further object of the present invention to provide a marking head of the aforementioned kind which is adapted to be connected to a so-called sealing gun provided with an explosive cartridge for furnishing the necessary striking force. The thus obtained implement can be easily handled since the weight and overall dimensions of the gun are small and since such a gun will provide the necessary striking force in order to effect with a single blow a group of markings with different characters. Furthermore, by using in the gun cartridges of different explosive force it is possible to adapt such implement to different materials to be stamped.

With these and other objects in view, which will become apparent as the descrption proceeds, the present invention includes in combination with a cartridge operated gun or striking tool having a barrel and a piston guided therein, a marking head comprising a housing and having a plurality of stamps movably guided in the housing and projecting beyond one end of the latter, means at the other end of the housing for connecting the barrel of the striking tool to the other end of the housing, and a force transmitting member in the housing for transmitting the blow imparted by explosion of the cartridge of the tool to the piston to the plurality of stamps.

The housing is open at one side thereof and includes a cover closing the open side of the housing and the cover as well as the plurality of stamps guided in the housing are provided with cooperating means to limit outward movement of the stamps. The marking head is further provided with means for braking the piston and with means for releasably holding the housing relative to the barrel at a selected one of a plurality of positions turned about the axis of the barrel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
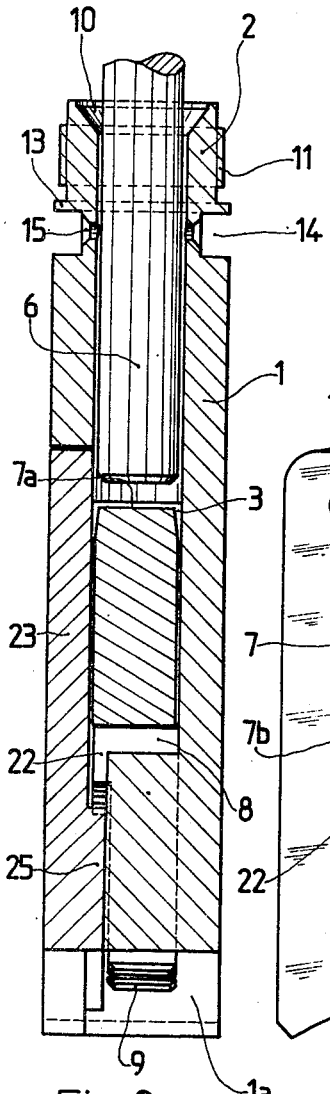
FIG. 2 is a longitudinal cross-section taken along said line III—III of FIG. 1.
Figure 1:
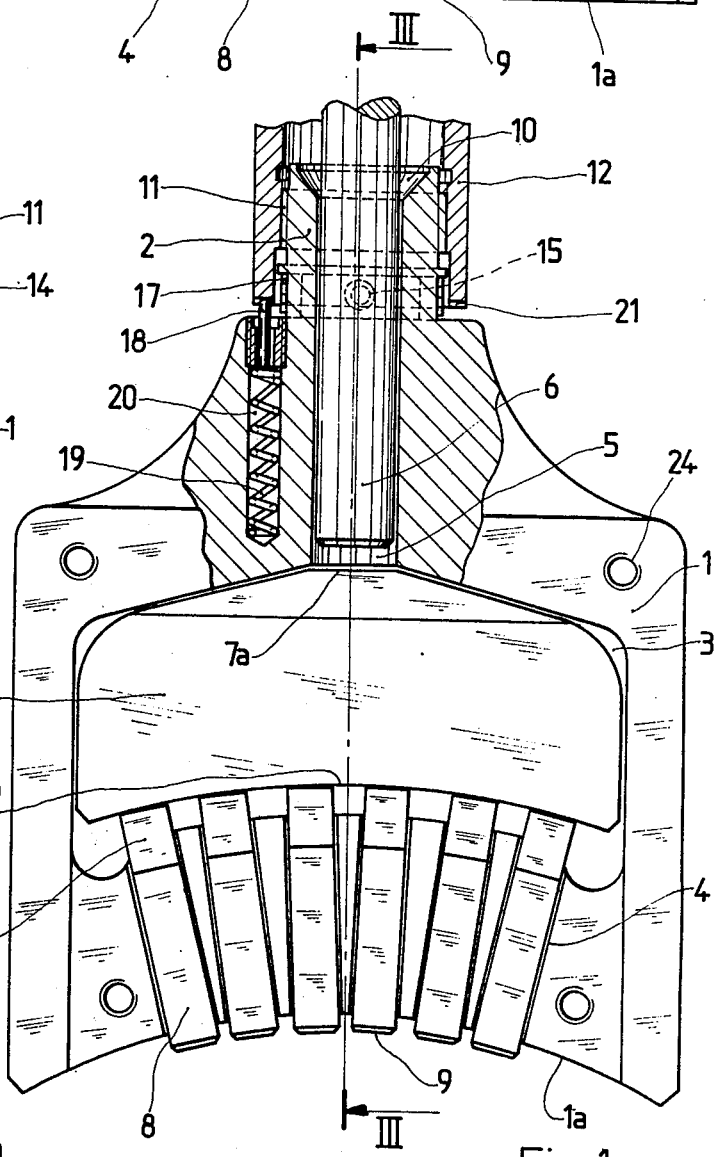
FIG. 1 is a partially sectioned side view of the stamping head according to the present invention with the cover of the housing removed and showing also part of the striking tool connected to the housing.

Referring now to the drawing, it will be seen from FIGS. 1 and 2 of the same, that the marking head according to the present invention comprises a housing 1 having at the upper end thereof, as viewed in the drawing, an upwardly projecting shank 2. A cavity 3 is provided in the interior of the housing which communicates at its lower end thereof with a plurality of channels 4 extending from the lower end of the cavity 3 to the bottom face 1*a* of the housing. As shown in FIG. 1, six of such channels 4 may be provided in the housing.

A central bore 5 extends longitudinally through the housing shank 2 into which the end portion of a piston 6 of a striking tool in form of a sealing gun of known construction extends to be slidably guided therein. The bore 5 communicates at the lower end thereof with the cavity 3, in which a plunger or force transmitting member 7 is slidably arranged. The plunger 7 has an upper central flat portion 7*a*, corresponding to the end face of the piston 6, which is adapted to strike onto the surface 7*a* of the plunger, whereas the wide base 7*b* of the plunger 7 is arranged to transmit the impact of the piston 6 on the plunger 7 to a plurality of stamps or punches 8 respectively arranged in the guide channels 4.

As can be seen from the embodiment illustrated in FIG. 1, the base 7*b* of the plunger 7 and the bottom face 1*a* of the housing 1 are concavely curved and the channels 4 are arranged radially with respect to the bottom face 1*a*, so that characters 9 engraved at the ends of the punches or stamps 8 may perfectly abut and act together on a corresponding convexly curved surface. It is to be understood that for marking planar surfaces, the base 7*b* of the plunger 7 and the bottom face 1*a* of the housing 1 may likewise be planar and parallel to each other in which case the channels 4 are arranged normal to the bottom face 1*a*, or that for marking concavely curved surfaces the base 7*b* of the plunger 7 and the bottom face 1*a* of the housing 1 may be convexly curved, with the channels 4 arranged radially to the bottom face 1*a*.

The marking head is constructed to be fixed to one end of a barrel 12 of a sealing gun and for this purpose a fitting is arranged at the region of the shank 2 for connecting the housing 1 of the marking head with the barrel of the sealing pin providing the necessary force for operating the marking head.

For this purpose the upper end of the bore 5 is provided with an annular chamfer 10 and the outer surface of the shank 2 is provided with an outer screw thread 11 cooperating with an inner screw thread provided in the inner surface of the barrel 12. A shoulder or annular flange 13 is provided below the screw thread 11 on the shank and below the flange 13 there are provided on the shank 2 a pair of opposite flats 14 into which countersunk bores 15 are formed which communicate at the inner ends with the axial bore 5. The transverse bores 15 receive each a ball, not shown in the drawing, which is maintained in position and pressed against the peripheral surface of the piston 6, in a known manner by spring clips 17. These balls serve to brake the piston 6 during the movement thereof. Cooperating means are also provided on the barrel 2 and the upper end of the housing 1 for releasably holding the housing relative to the barrel in a selected one of a plurality of positions turned about the axis of the barrel, so that if the gun is held in a certain position by the operator, the housing 1 and the stamps 8 thereof may be adjusted relative to the gun so as to mark the surface with a row of symbols extending in different directions with respect to the gun. These releasable holding means may comprise a finger or dog 18 arranged in a bore 20 provided in the housing, laterally spaced and parallel to the bore 5, and the finger 18 is biased upwardly by a coiled compression spring 19 in the bore 20 to engage with the upper end thereof in a selected one of a plurality of, for instance four, circumferentially displaced V-shaped notches 21 provided in the bottom face of the barrel 12.

Figure 3:
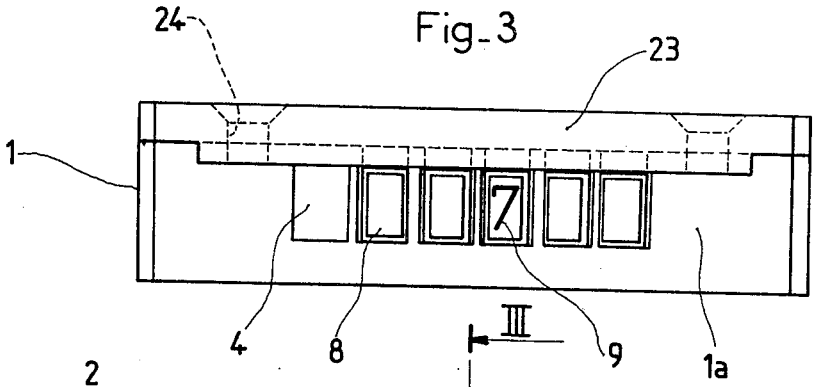
FIG. 3 is a bottom view of the marking head.

The punches or stamps 8 slidably guided in the channels 4 of the housing 1 are provided at the upper ends thereof with laterally projecting heels 22. The housing 1 is open at one side thereof, which is closed by a cover 23 connected to the housing 1 by screws extending through a plurality of threaded bores 24 which, as shown in FIG. 3, are countersunk at the outer ends thereof. A shoulder 25 projects from the inner surface of the cover 23 into the cavity 3 in the region of the lower end of the latter and the shoulder 25 is arranged to be engaged by the laterally projecting heels 22 of the punches 8 to limit the outward movement of the latter.

The above-described apparatus will be operated as follows:

The cover 23 is first removed so that a plurality of punches or stamps 8 with the proper symbols 9 provided at the lower ends thereof for the desired stamping may be placed into the channels 4. Subsequently thereto the cover is refastened to the housing 1. Thereafter the shank 2 of the housing is threaded into the lower end of the barrel 12 and the upper end of the dog 18 is arranged in a selected notch 21 of the barrel to orient the housing relative to the gun. The apparatus is now ready to function and the bottom face 1*a* of the housing 1 is placed in proper position onto the surface to be marked.

The operator now presses onto a trigger of the gun to cause explosion of a cartridge therein which drives the piston 6 against the plunger 7, which in turn, transmits the impact provided by the piston simultaneously to all of the stamps 8. By using cartridges of different explosive force the implement may be adapted for properly marking metallic surfaces of different hardness.

The use of the marking head according to the present invention is extremely simple and it permits easy exchange of the stamps 8 according to the desired markings. The stamps 8 are automatically properly oriented in the channels 4 since the heels 22 prevent inverse mounting of the stamps 8 in the channels.

It will be understood that each of the elements described above, or two or more together, may also find a useful application in other types of marking heads for cold stamping symbols on metallic surfaces differing from the types described above.

While the invention has been illustrated and described as embodied in a marking head for cold stamping symbols on a metallic surface to be connected to a sealing gun having a cartridge providing, when exploded, the necessary driving force for the stamps of the marking head, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for the various applications without omitting features that, from the standpoint of prior art, fairly constitute essential characteristics of the generic or specific aspects of this invention.

What is claimed as new and desired to be protected by Letters Patent is set forth in the appended claims.

1. In combination with a cartridge operated striking tool having a barrel and a piston guided in said barrel, a marking head comprising a housing having opposite ends and being formed with a cavity and a plurality of channels extending from said cavity to one of said opposite ends of said housing, said housing including a central shank projecting from the other end thereof and being provided with a central bore therethrough communicating with said cavity, the piston of said striking tool extending with a an end portion thereof through said bore; a plurality of stamps respectively located in said channels to be guided therein movable in longitudinal direction and projecting with ends thereof beyond said one end of said housing; means at the other end of said housing for connecting said other end of said barrel of said tool turnably about the axis of said barrel, said connecting means comprising an outer screw thread on said shank and screwed into a corresponding inner screw thread in said barrel; a force transmitting member located in said cavity between said piston and said stamps for transmitting a blow imparted by explosion of a cartridge to the piston onto the plurality of stamps; means for releasably holding said housing in a selected one of a plurality of fixed positions turned about the axis of said barrel; and means for braking said piston and comprising a pair of opposite transverse bores in said shank intersecting said axial bore, a pair of balls respectively located in said transverse bores, and spring clips pressing said balls against the periphperal surface of said piston.

2. A marking head as defined in claim 1, wherein said bores are countersunk at the outer ends thereof.

3. A marking head as defined in claim 1, wherein said housing is open at one side thereof and including a cover closing said open side of said housing, said cover forming at an inner face thereof a shoulder extending into said cavity in the region of inner ends of said channels.

4. A marking head as defined in claim 3, wherein each of said stamps is provided with a projecting heel adapted to engage said shoulder of said cover for limiting outward movement of said stamps relative to said housing.

5. A marking head as defined in claim 1, wherein said housing has at said one end a curved end face, said channels are arranged radially with respect to said curved end face of said housing, and said force transmitting member has a base directed towards said one end face of said housing and being curved in correspondence with the curvature of said end face.

6. A marking head as defined in claim 5, wherein said one end face of said housing and said base of said force transmitting member are concavely curved.

7. A marking head as defined in claim 6, wherein said stamps are engraved at end faces thereof projecting beyond said end face of said housing, and said end faces of said stamps being located at an imaginary concave surface substantially parallel to said curved end face of said housing.

8. A marking head as defined in claim 1, wherein said housing has at said one end a planar end face, and said base of said force transmitting member being directed to said one end of said housing and being parallel to said planar end face of the latter, and wherein said plurality of channels are normal to said planar end face of said housing.

9. A marking head as defined in claim 1, wherein said bore is provided at its outer end thereof with an annular chamfer.

10. A marking head as defined in claim 1, wherein said releasably holding means comprises a plurality of circumferentially displaced notches in an end face of said barrel and a spring biased dog carried by said housing at the other end thereof and engaged in a selected one of said notches.

* * * * *